US007093395B2

(12) United States Patent
Hinault et al.

(10) Patent No.: US 7,093,395 B2
(45) Date of Patent: Aug. 22, 2006

(54) SPORTS FLOOR PARTICULARLY FOR GYMNASIUMS

(75) Inventors: Robert Hinault, Marcilly d'Azergues (FR); Alain Rivat, Les Sauvages (FR)

(73) Assignee: Gerflor, Villeurbanne (FR)

( * ) Notice: Subject to any disclaimer, the term of this patent is extended or adjusted under 35 U.S.C. 154(b) by 65 days.

(21) Appl. No.: 10/802,348

(22) Filed: Mar. 17, 2004

(65) Prior Publication Data

US 2004/0182030 A1 Sep. 23, 2004

(30) Foreign Application Priority Data

Mar. 20, 2003 (FR) ..... 03 03663

(51) Int. Cl.
*E04B 1/82* (2006.01)
*E04F 13/08* (2006.01)

(52) U.S. Cl. ..... 52/43; 52/403.1; 52/480; 52/92

(58) Field of Classification Search ..... 52/403.1, 52/480, 591.4, 392, 793.1, 793.11, 390; 472/92
See application file for complete search history.

(56) References Cited

U.S. PATENT DOCUMENTS

| | | | | |
|---|---|---|---|---|
| 2,960,197 | A * | 11/1960 | Langhans | 428/116 |
| 3,389,451 | A * | 6/1968 | Speca et al. | 29/897.15 |
| 4,330,494 | A * | 5/1982 | Iwata et al. | 264/46.2 |
| 4,573,304 | A * | 3/1986 | Mieyal | 52/793.11 |
| 4,682,459 | A * | 7/1987 | Stephenson | 52/390 |
| 4,685,259 | A * | 8/1987 | Eberhart et al. | 52/144 |
| 4,689,870 | A * | 9/1987 | Mieyal | 29/469.5 |
| 4,727,697 | A * | 3/1988 | Vaux | 52/177 |
| 4,832,147 | A * | 5/1989 | Dear et al. | 181/30 |
| 4,948,116 | A * | 8/1990 | Vaux | 472/92 |
| 5,667,444 | A * | 9/1997 | Caballero | 472/92 |
| 6,099,683 | A * | 8/2000 | Meier et al. | 156/292 |
| 6,673,417 | B1 * | 1/2004 | Gudet | 428/156 |
| 6,804,923 | B1 * | 10/2004 | Potter | 52/480 |
| 6,871,363 | B1 * | 3/2005 | Sabados | 4/506 |
| 6,880,303 | B1 * | 4/2005 | Mead | 52/263 |
| 2004/0048022 | A1 * | 3/2004 | Pratt | 428/36.91 |

FOREIGN PATENT DOCUMENTS

| | | |
|---|---|---|
| DE | 30 00 300 | 7/1981 |
| DE | 39 04 223 | 8/1990 |
| EP | 0 411 653 | 2/1991 |
| EP | 1 260 655 | 11/2002 |
| FR | 2 417 589 | 9/1979 |
| FR | 2 812 898 | 2/2002 |

* cited by examiner

*Primary Examiner*—Carl D. Friedman
*Assistant Examiner*—Abdul Manaf
(74) *Attorney, Agent, or Firm*—Heslin Rothenberg Farley & Mesiti P.C.

(57) ABSTRACT

A floor composed of a plurality of modular elements comprises a first subassembly consisting of a base component and a first intermediate element and a second subassembly consisting of a second intermediate element and a top component forming a point elastic floor. The two subassemblies are secured together by connecting means with an angular orientation offset such as to define the contact surfaces and allow assembly by interlocking. The intermediate elements are disposed with a median honeycomb structure sandwiched between two stiffening plates of the same format and dimension. The plates are of nonwoven material and have reinforcement and stiffening disposed in a canvass of warp and weft threads.

4 Claims, 7 Drawing Sheets

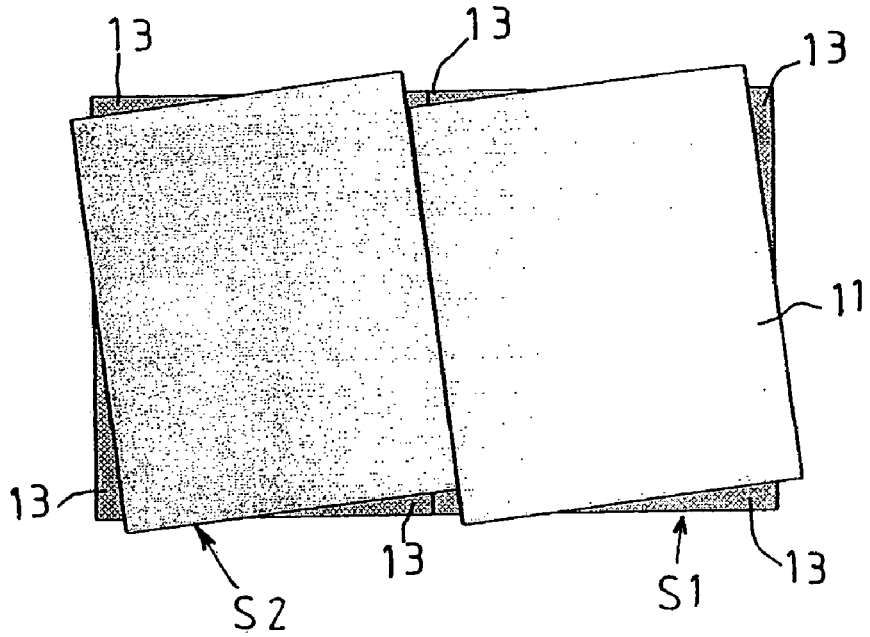
FIG.6
FIG.7
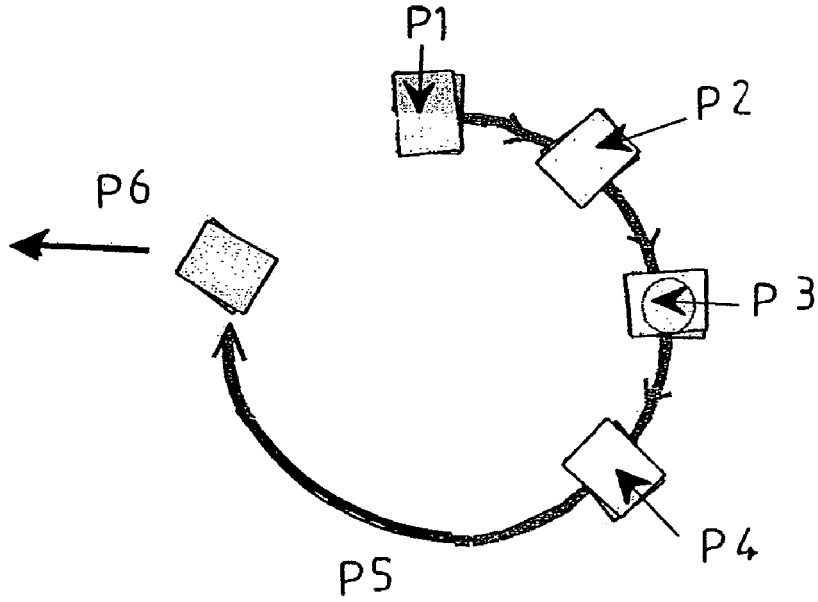

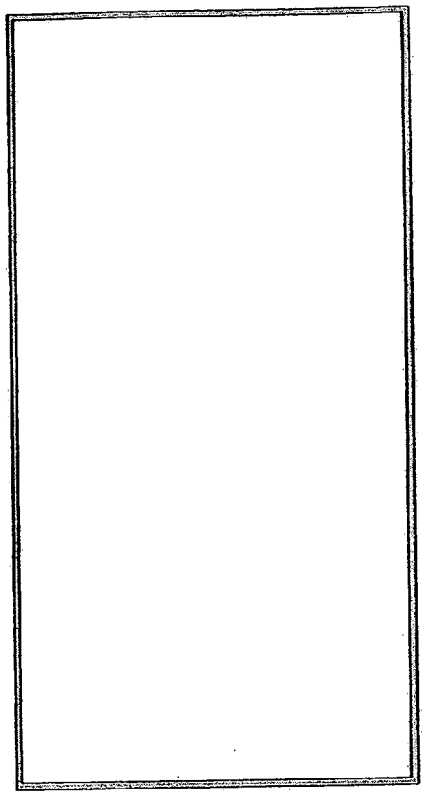
FIG.11
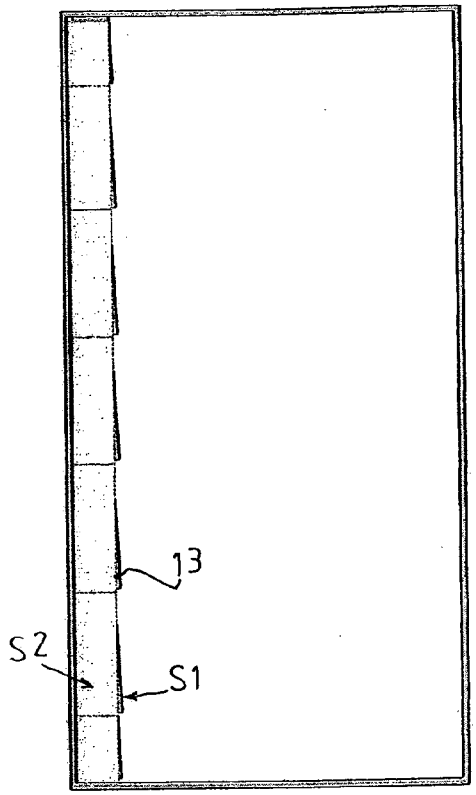
FIG.12
FIG.13
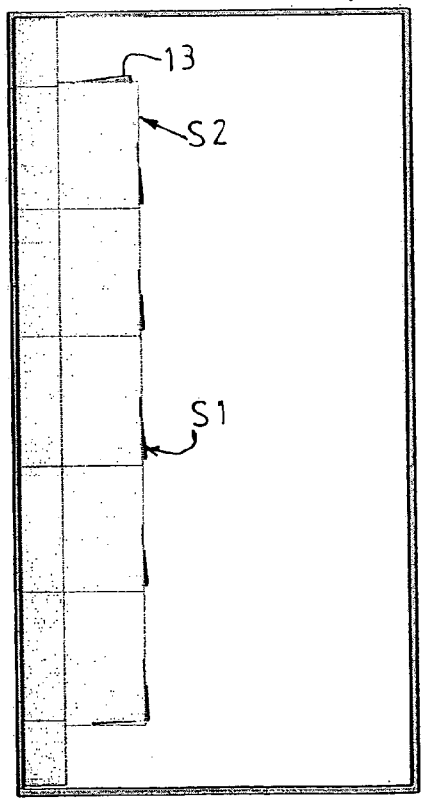
FIG.14
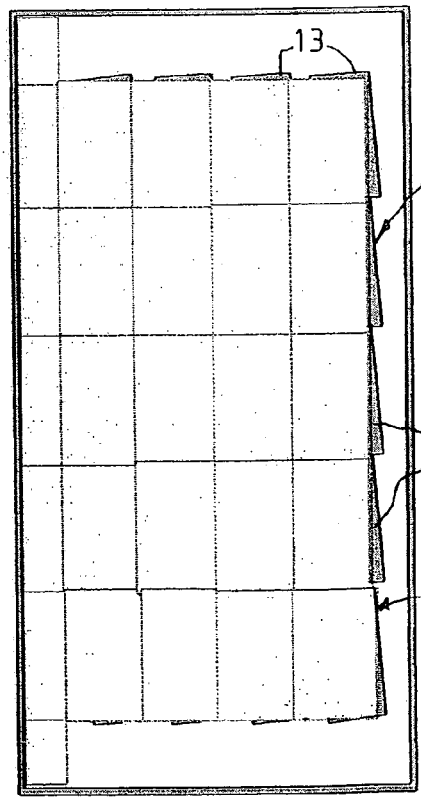

SPORTS FLOOR PARTICULARLY FOR GYMNASIUMS

The invention relates to the technical sector of sports floors used in gymnasiums and other locations fitted out permanently or temporarily on the occasion of sporting events.

According to the prior art, many designs of sports floors have been produced to satisfy the requirements not only of high ranking sports competition, but also for the practice of physical and sporting activities of lower levels, such as for school use. The technical criteria of sports floors therefore vary depending on the required use, but that brings with it financial and economic constraints, because the investments are costly and must be able to be rapidly amortized. The practice of sporting disciplines, and physical disciplines in general, demands floor areas of the order of 800 $m^2$ to 1000 $m^2$ for sports such as basketball, handball, gymnastics, etc, that is to say that the choice and design of sports floors in relation to their criteria and conditions of use have considerable financial consequences. Currently, and to the knowledge of the Applicant who has wide experience in the design and fabrication of this type of floor, prices vary between €40 and €100 per $m^2$.

According to current techniques, different types of sports floors have been proposed, such as point elastic floors, area elastic floors and combined elastic floors.

Point elastic floors are made of synthetic materials produced in one or more layers and coming in the form of strips rolled out to the desired length, and are placed directly onto the receiving concrete base. In this implementation, the weight of the athlete is spread over an area only slightly greater than the surface area of the latter's foot and therefore of the impact zone by a value of the order of a few centimeters (3 to 5 cm) around the foot. This type of covering is satisfactory in relation to its low cost and its properties of durability (wear, maintenance, resistance to impacts). However, the sporting properties are extremely limited due to the thickness-flexibility compromise of the floor which prevents the cushioning layer from being increased without experiencing problems of stability of support. The conditions of use of this type of floor are restricted to school gymnasiums or to regional level competitions.

The investment is appropriate to the conditions of use.

Area elastic floors are made of wood-based materials, the load of the athlete being spread over an area much greater than the area of the foot (approximately 50 cm around the foot). In this implementation, the area elastic floor receives, starting from the concrete base, a first covering made of polyurethane foam of a certain thickness onto which are placed two superposed tiers of wood panels arranged in staggered pattern, with a finish covering.

This type of floor is used in particular and is preferable in halls where basketball is played, particularly competitive basketball, due to the sporting properties provided by these floors.

However, the investment in an area elastic sports floor of this type is extremely high. The fitment and installation time is long due to the disposition of the two tiers of wood panels and the difficulties of correctly filling the whole surface area of the hall in question. In addition, and from the technical point of view, certain disadvantages have been observed. The wood panels are sensitive to humidity which tends to rise from the concrete base. This may alter the characteristics of the floor with inappropriate effects. Furthermore, the cost of maintenance is high with the requirement for regular revarnishing.

Furthermore, the wood panels may expand and deform due to the ambient environment and temperature, and thus modify the conditions of sealing between panels. If there is a change in the quality of the floor, and even in a mere portion of the latter, the whole floor has to be replaced.

Due to these constraints, area elastic floors are used only in high level national and international sports halls and gymnasia for particular sporting activities such as basketball, handball and volleyball.

With regard to all these constraints, floors called combined elastic floors have been proposed which combine, by superposition, an area elastic floor with a point elastic floor thus combining the properties of an area elastic floor (greater spread of the load) with those of the point elastic floor (flexibility and comfort for the athlete). The combined elastic type of floor makes the cost lower than that of an area elastic floor but still higher than the cost of a point elastic floor. FIG. 1 therefore shows this type of floor with the layer of polyurethane foam (1) placed on the concrete base (2), the two tiers of wood panels (3–4) and the point elastic floor (5).

This type of combined elastic floor in its design is a good compromise, but nevertheless still has drawbacks. Assembly is carried out in the location of installation and fitment and installation time constraints are always found to require a degree of dexterity and expertise in the installer. There are also drawbacks relating to the use of the wood panels and environmental constraints (humidity, heat). Furthermore, in this implementation, the maintenance of and responsibility for the quality of installation of the combined elastic floor is transferred to the individual installer, the designer-manufacturer of the combined elastic floor thus being distanced for the aforementioned reasons.

The approach of the Applicant, who, for many years, has been a manufacturer of sports floor coverings, marketed in particular under the "TARAFLEX" brand very widely known in the field of sport, has been to reconsider the conditions of design of combined elastic sports floors to propose a concept and product at a competitive price relative to point elastic floors, while escaping the constraints relating to the ambient environment (humidity, heat) and facilitating the installation of the covering with a substantial reduction in the time to fit and install the sports floor which is the subject of the invention.

Furthermore, the Applicant, in his approach, wanted to dispense with depending on the intervention of installers, and permit the choice of personnel who are less specialized and therefore easier to find in the labor market.

Another approach used by the Applicant has been to design a new combined elastic sports floor while reducing the costs and constraints of upkeep and maintenance.

These aims and others will clearly emerge in the rest of the description.

According to a first feature of the invention, a combined elastic sports floor of the type comprising a base component designed on the basis of polyurethane foam intended to be in contact with a receiving base slab, two rows of intermediate elements and a point elastic floor of the type comprising a plurality of complete modular elements established according to a specific format and dimension, in a structural configuration enabling them to be assembled by interlocking, and a plurality of modular edging elements having one and the same structure, is remarkable in that the plurality of modular elements comprises a first subassembly consisting in the association of a base component and a first intermediate element, and a second subassembly consisting in a second intermediate element and a top component forming the point elastic floor, the two subassemblies being secured one to the other by connecting means with an angular orientation offset in order to define the contact surfaces and allow assembly by interlocking, and in that the intermediate elements are disposed with a median honeycomb structure sandwiched between two stiffening plates of the same format and dimension, said plates being of nonwoven material and having means of reinforcement and stiffening, and in that the plates have means of reinforcement disposed in a canvass of warp threads and weft threads.

These features and others will clearly emerge in the rest of the description.

In order to fix the subject of the invention illustrated in nonlimitative fashion in the figures of the drawings in which:

FIG. 6 is a view of a subassembly of the sports floor made of two modules obtained according to the invention and assembled ready for installation.

FIG. 7 is a schematic view illustrating the process of fabricating the subassemblies.

FIGS. 11, 12, 13, 14 illustrate the method of installing the subassemblies according to the invention.

Figure 1:
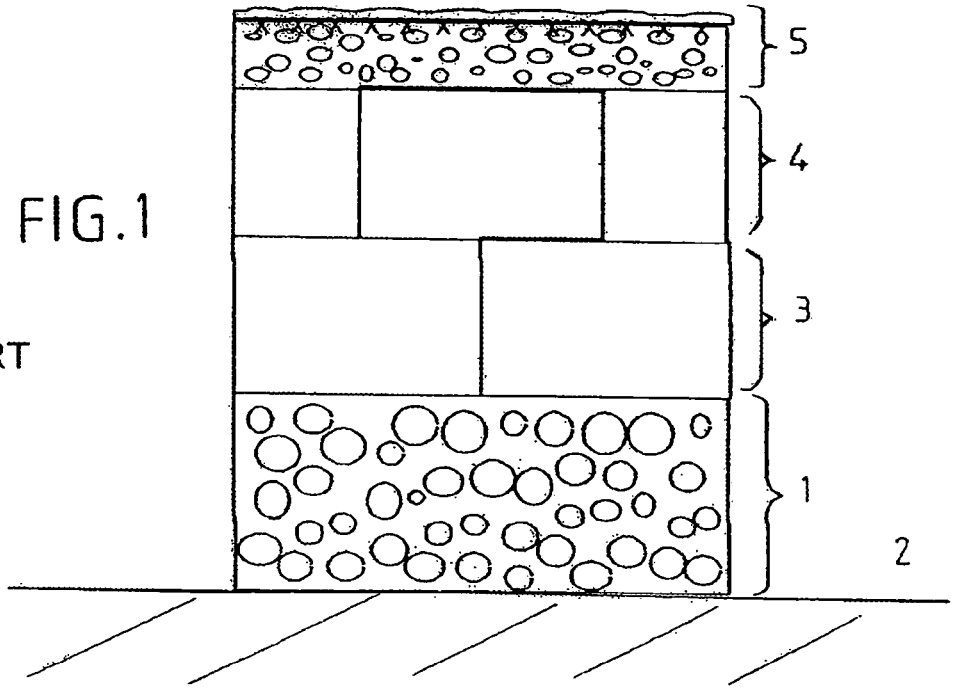
FIG.1 PRIOR ART
FIG. 1 is a sectional view of a combined elastic sports floor according to the prior art.
Figure 2:
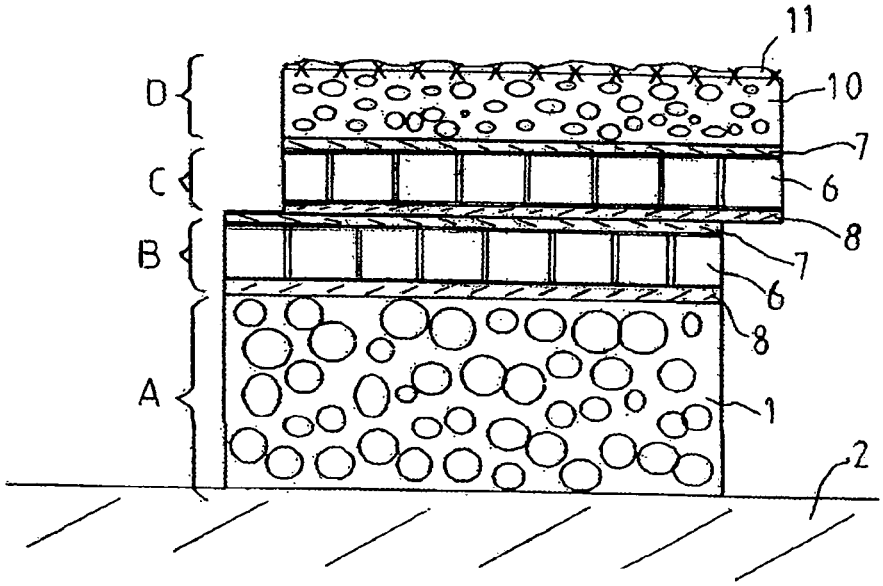
FIG. 2 is a sectional view of a combined elastic sports floor according to the invention.
Figure 3:
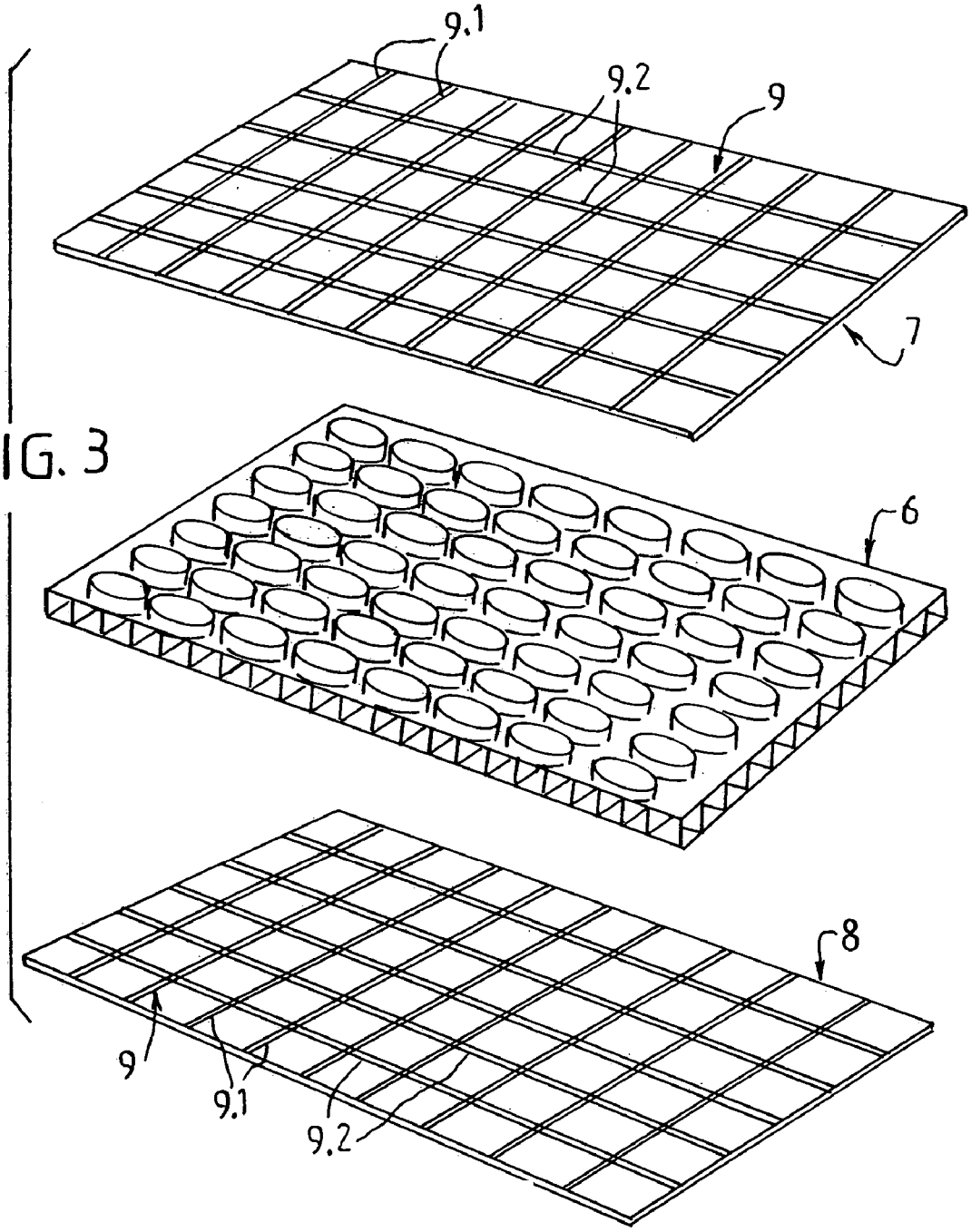
FIG. 3 is a view in perspective, prior to assembly of a module, of a plate produced in a honeycomb structure before assembly.
Figure 5:
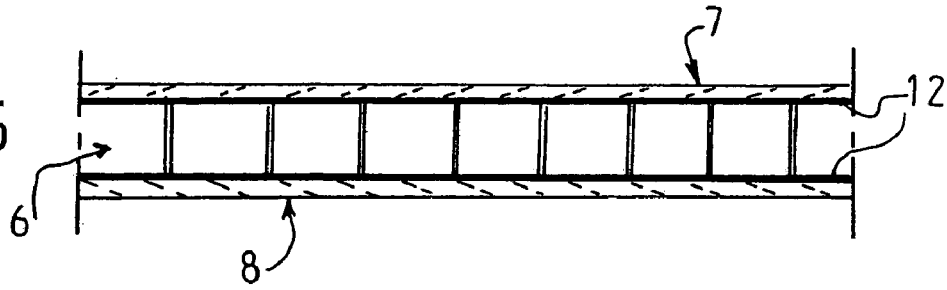
FIG. 5 is a partial sectional view based on FIG. 3.
Figure 4:
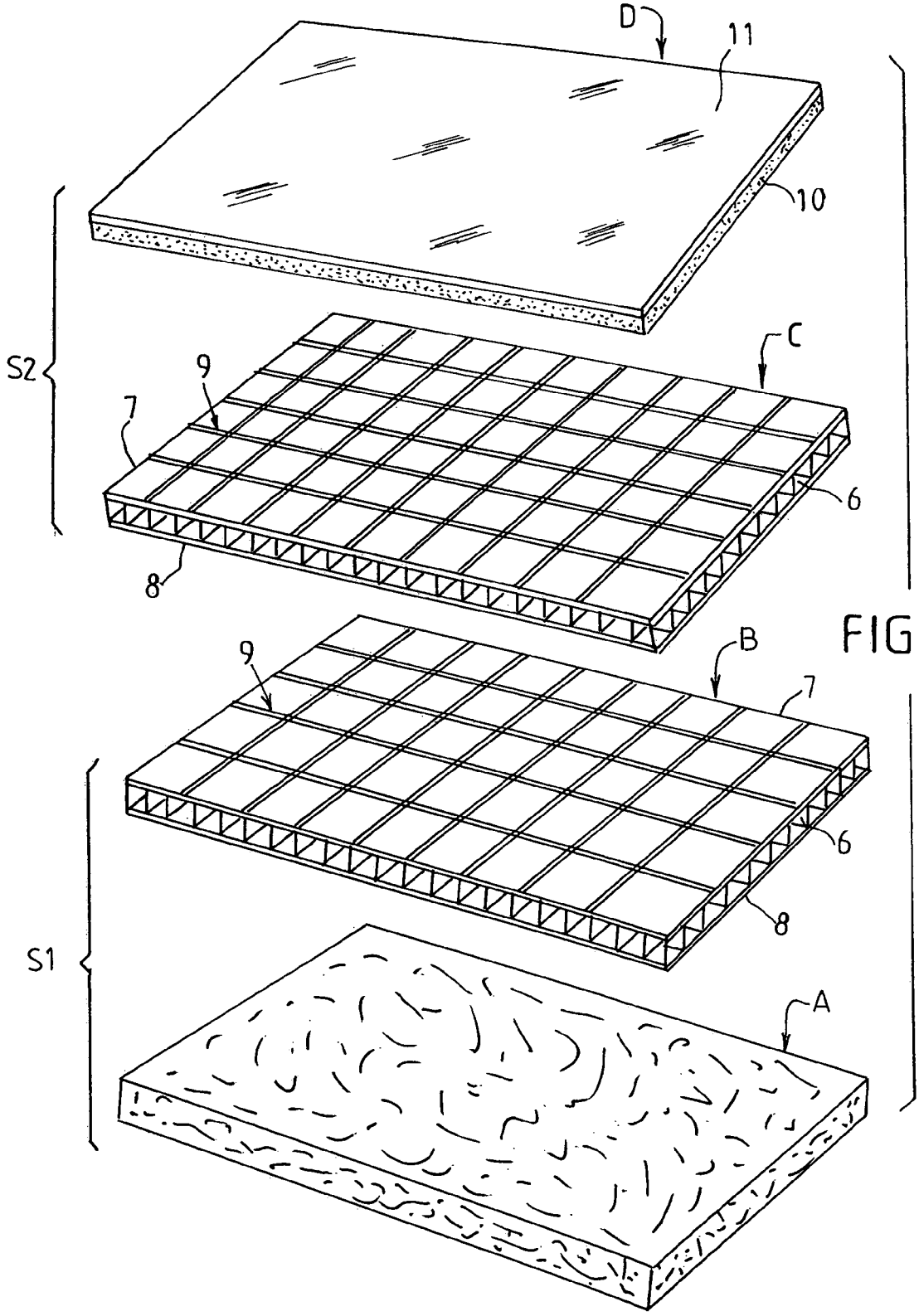
FIG. 4 is a view in perspective, prior to assembly, of a combined elastic sports floor according to the invention as in FIG. 2.

In order to give more substance to the subject of the invention, it will now be described in a nonlimitative manner illustrated in the figures of the drawings.

The combined elastic sports floor according to the invention is designed to be fabricated in modules and subassemblies that are intended for rapid assembly according to a kit assembly so that they can be fabricated, delivered, and fitted in optimum conditions making the proposed concept particularly attractive.

With reference to the drawings, the sports floor according to the invention comprises four components (A–B–C–D) which are assembled as explained hereafter, that is a base component (A) intended to be laid on the concrete base (2) of the hall to be covered, two identical intermediate components (B–C) in a particular structure other than wood panels and a top component (D) constituting the point elastic floor.

The base component (A) is made in the form of a layer of polyurethane foam obtained for example with recycled material. This layer is of a certain thickness of the order of at least 15 millimeters in contact with the concrete base (2). The two intermediate components (B–C) constitute in themselves modules in the form of plates or panels which are rectangular for example. Each module is made according to a particular design, in a material other than wood and more specifically in a specific synthetic or composite plastic material providing a lightness loading. In an original manner, each module has a median honeycomb structure (6) based on plastic material, and preferably on polypropylene or similar material receiving on its outer and lower face two identical rigid plates (7–8) made of a nonwoven material, each plate being secured to the honeycomb structure by any appropriate means, bonding or other. Each plate (7–8) is thin and covers the whole honeycomb structure (6) to configure a module. Specifically, each plate (7–8) incorporates means of reinforcement (9) disposed in a configuration of weft threads (9.1) and warp threads (9.2). These means of reinforcement are for example made from glass fibers. The module thus produced, with its honeycomb structure allows air circulation and therefore provides aeration of the combined elastic floor and so effectively combats the effects of the rise of humidity from the concrete base (2). Furthermore, the disposition and orientation of the means of reinforcement confer rigidity on the plate and therefore on the subassembly defined by the two loads and the honeycomb structure. This also provides dimensional stability.

The top component (D) constitutes the point elastic floor portion and is made in conventional manner with a base of foam (10) onto which the visible external layer (11) is placed.

According to the invention, the implementation of these four components is carried out as follows. In one specific implementation of the invention, the four components are made in one and the same dimensional format for subsequent assembly in the following optimized conditions.

The design of the combined elastic sports floor according to the invention is such that it allows various options of fabrication and delivery in situ of the components depending on the degrees of intervention required by the manufacturer and the clients.

For total supply of the whole sports floor, there follows a description of a first implementation of the method of fabricating the components of the invention ready for installation.

In this instance, the manufacturer produces two subassemblies (S1–S2). The first subassembly associates the base component (A) with first intermediate module (B) secured together by a bonding coat (12) such as glue or similar. This coat provides the specific connection of the upper face of the component (A) with the plate facing it of the module concerned. The second subassembly (S2) is made from the outer component (D) or point elastic floor, and the second intermediate module (C) by means of the stiffening plate (7) facing it. Thus, the two subassemblies (S1–S2) are made according to the same format and dimensions for subsequent assembly with the aid of an adhesive bonding connecting means.

According to the invention and as shown in FIG. 6, the two subassemblies (S1–S2) site against one another in an angular offset position with a few degrees of offset, so that they cannot be superposed fully and so that they can be interlocked during fitment. Thus, offsets defining contact cheeks (13) appear in the corner regions when the complete modular assemblies are put together integrating the two subassemblies (S1–S2). These modular assemblies are held directly against one another in a rapid in situ fitment.

FIGS. 8 to 16 illustrate an example of the implementation of the covering of a hall with a combined elastic sports floor according to the invention based on the concept of the invention.

Figure 8:
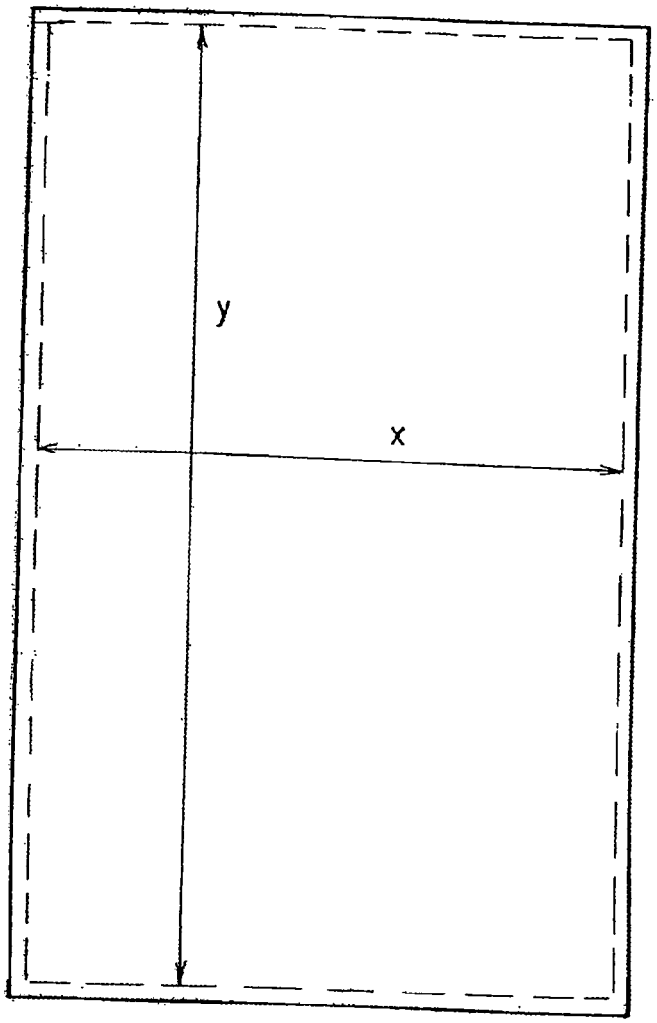
FIG. 8 is a view illustrating the preliminary phase of surveying the dimensions of the hall to be fitted out with the sports floor according to the invention.

According to FIG. 8, the hall is surveyed, that is its dimensional characteristics are defined and the complete modular assemblies and the cut modular assemblies are defined and calculated for the execution and filling of the periphery of the hall. Thus the dimensions x and y of the hall in the perpendicular planes are defined. According to FIG. 9, after the number of modular assemblies necessary to cover the width of the hall widthwise has been calculated, with the edging assemblies being deducted, the edging assemblies are defined and cut to the required dimension along the line a.a in FIG. 9. This produces a partial modular assembly having a straight edge after cutting intended to be along the length of the hall. The same procedure is carried out with the modular edging assemblies according to FIG. 10 and intended to be across the width of the hall.

The following phases are illustrated hereafter.

FIG. 11: The hall contains no modular elements.

Figure 9:
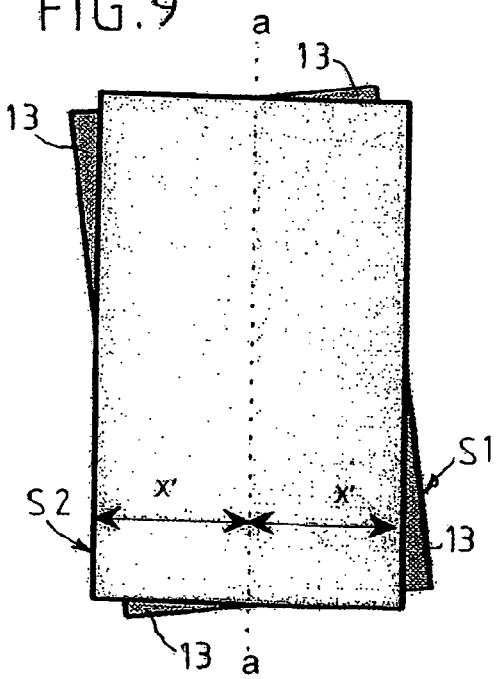
FIGS. 9 and 10 are views of the border subassemblies intended to be cut and laid on the periphery of the hall.
Figure 10:
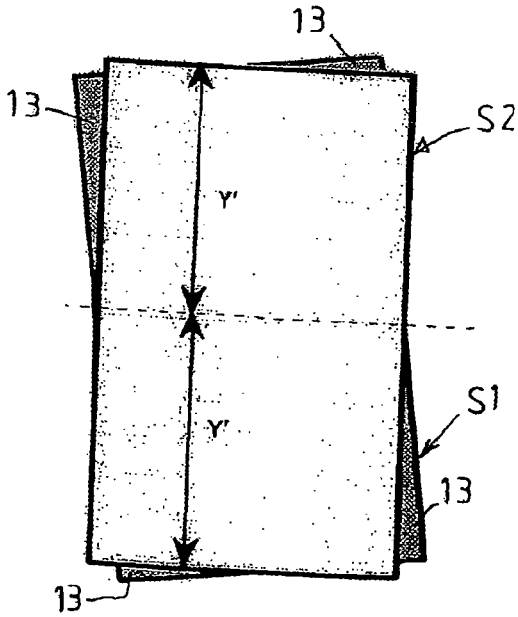

FIG. 12: A plurality of partial modular elements obtained according to FIG. 9 is disposed lengthwise along the length of the edge of the hall.

FIG. 13: Adjacent to the plurality of partial modular elements are placed complete modular elements with the exception of the lateral extremities.

FIG. 14: The hall is filled with complete and partial modular elements except for the periphery on three contiguous sides.

Figure 15:
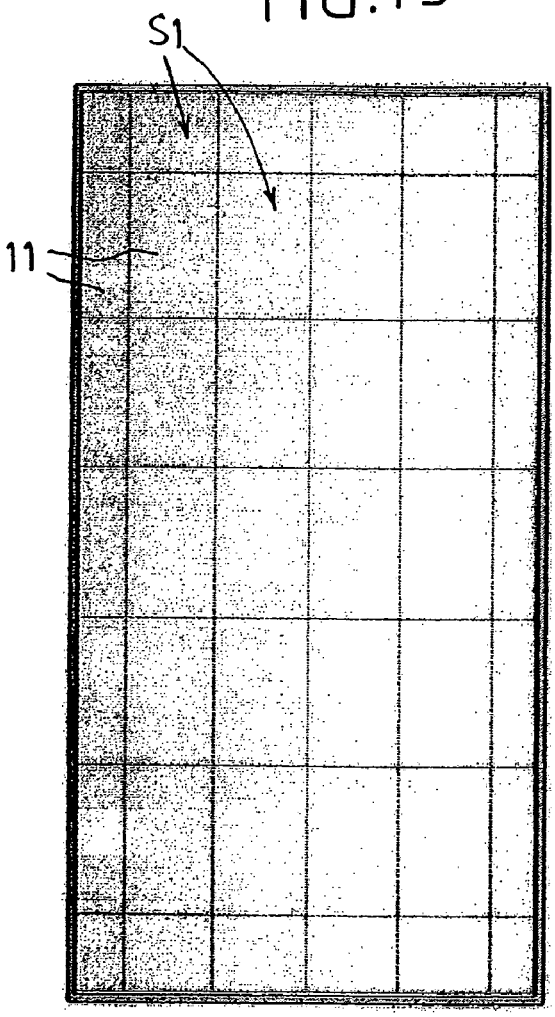
FIG. 15 illustrates the installation of the subassemblies of the periphery.
Figure 16:
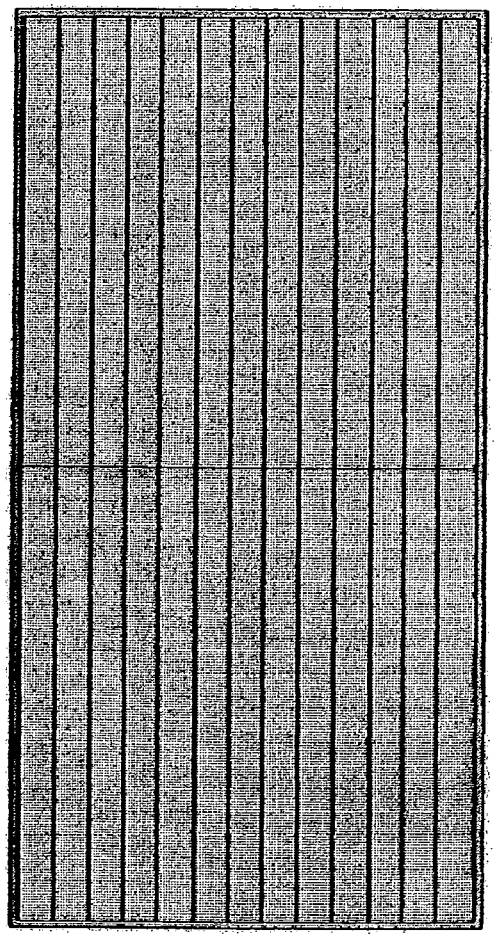
FIG. 16 illustrates the bonding of the sports floor.

FIG. 15: The sports floor is finished off with the assembly and installation of the modular edging elements.

Assuming that the two previously described assemblies (S1–S2) have been completed, the hall is almost finished except for the execution of secondary accessory work.

As a fabrication variant, it is possible to conceive of delivering the subassemblies differently, such that the point elastic floor can be rolled out in strips along the whole length of the hall and does not have to be directly associated in fabrication with the intermediate component (C). The latter is secured to the subassembly (S1) in the same manner as aforementioned and in the same position. The point elastic floor is then built up as shown for example in FIG. 16.

FIG. 7 represents the process of fabrication in a diagram of automation of the complete modular assemblies in the point elastic floor portion.

The phase P1 of the method consists in producing the component (A), that is the polyurethane foam, on one of the faces of which a bonding agent is disposed.

The phase P2 constitutes the bonding of the first intermediate component (B) onto the component (A).

The following phase P3 consists in bonding the intermediate component (B) onto the plate facing it, onto all or a portion of the latter.

The phase P4 consists in placing the second intermediate component in a position offset relative to the first.

The following phase P5 consists in an operation of pressing the subassemblies (S1–S2) together for a rigid bond.

The following phase P6 consists in clearing away the modular assembly obtained, for storage and delivery in situ.

The new concept of combined elastic sports floors according to the invention has many advantages.

It should be emphasized first of all that it lends itself to industrial-scale manufacture of prefabricated elements in kit form thus considerably reducing the fabrication costs.

Emphasis should be laid on the lightness of the modular assemblies obtained. The sporting properties of this type of sports floor are on a par with the high and very top-of-the-range area elastic floors, but at a price on a par with point elastic floors.

The particular honeycomb structure of the intermediate components (B–C) provides an solution to the problem of humidity in the concrete base. The intermediate components are unaffected by humidity and there is no risk of deformation of the floor.

Fitment and installation of the partial and complete modular elements are easy, quickly done and do not require the intervention of qualified personnel.

It is also possible with great ease and without excessive additional cost, at least not proportionally higher cost, to vary the depth and thickness of the honeycomb structures as a function of the technical and sporting criteria sought.

The materials constituting the components (A, B, C) are chosen as a function of the installations and may be based on recycled materials, for example when seeking to limit the costs.

Another advantage of the invention lies in the fact that it is possible to work and cut the modular edging elements to varying shapes in order to take account of certain constraints of environment connected with the hall.

Without departing from the context of the invention, it can be conceived for the formats of the modular assemblies to be of geometric, rectangular or square configurations or of other polygonal shapes.

Also worthy of note are the excellent sporting properties of the sports floor according to the invention. In relation to the standard DIN 18032, the results of the tests carried out are as follows:

force reduction=60% standard deformation (vertical)=3 mm energy return=0.8 m/s

W100 deformation trough=0

The finished material is of a weight equivalent to the area elastic structure with wood panels for the polystyrene plates and lighter for the subassemblies made of the honeycomb structure in nonwoven plates.

Thus the invention has many advantages and also offers unparalleled quality of performance and value for money.

The invention claimed is:

1. Combined elastic sports floor of the type comprising a base component of polyurethane foam intended to be in contact with a receiving base slab, two rows of intermediate elements and a point elastic floor, the sports floor comprising a plurality of complete modular elements having a specified format and dimension, in a structural configuration enabling them to be assembled by interlocking, and a plurality of modular edging elements having a structure identical to the complete modular elements, wherein the plurality of complete modular elements each comprises a first subassembly comprising the base component secured to a first intermediate element, and a second subassembly comprising a second intermediate element and a top component forming the point elastic floor, the first and second subassemblies being secured one to the other by connecting means with an angular orientation offset in order to define contact surfaces and allow assembly by interlocking, and wherein the first and second intermediate elements each comprise a median honeycomb structure sandwiched between two stiffening plates of the same format and dimension, said plates being of nonwoven material and having means of reinforcement and stiffening disposed in a configuration of warp threads and weft threads.

2. Sports floor according to claim 1, wherein the means of reinforcement are made of glass fiber.

3. Sports floor according to claim 1, wherein connecting means of an adhesive coat type are used to connect the components together.

4. Sports floor according to claim 1, wherein the modular edging elements are only cut in a transverse or longitudinal plane to obtain a straight edge for installation along an outer periphery of a hall to be fitted out.

* * * * *